US009583236B2

(12) United States Patent
Arzate et al.

(10) Patent No.: US 9,583,236 B2
(45) Date of Patent: Feb. 28, 2017

(54) METHOD FOR MANUFACTURING AN IMPROVED OVERHEAD AND UNDERGROUND CABLE LEAD-IN CABLE FOR VOICE, DATA AND VIDEO TRANSMISSION SERVICES

(71) Applicants: Fermin Marquez Arzate, Queretaro (MX); Victor Osornio, Queretaro (MX)

(72) Inventors: Fermin Marquez Arzate, Queretaro (MX); Victor Osornio, Queretaro (MX)

(73) Assignee: SERVICIOS CONDUMEX, Queretaro (MX)

( * ) Notice: Subject to any disclaimer, the term of this patent is extended or adjusted under 35 U.S.C. 154(b) by 328 days.

(21) Appl. No.: 13/999,296

(22) Filed: Feb. 8, 2014

(65) Prior Publication Data

US 2014/0366368 A1 Dec. 18, 2014

Related U.S. Application Data

(62) Division of application No. 10/780,021, filed on Feb. 17, 2004, now abandoned.

(30) Foreign Application Priority Data

Dec. 11, 2003 (MX) ..... PA/a/2003/011491

(51) Int. Cl.

| | |
|---|---|
| ***H01B 13/016*** | (2006.01) |
| ***H01B 7/28*** | (2006.01) |
| ***H01B 13/14*** | (2006.01) |
| ***H01B 7/22*** | (2006.01) |
| ***H01B 11/02*** | (2006.01) |
| ***H01B 7/02*** | (2006.01) |
| ***H01B 7/08*** | (2006.01) |
| ***H01B 11/00*** | (2006.01) |

(52) U.S. Cl.
CPC ..... *H01B 13/0165* (2013.01); *H01B 7/0208* (2013.01); *H01B 7/0216* (2013.01); (Continued)

(58) Field of Classification Search
CPC ... H01B 13/016; H01B 13/0165; H01B 13/14; H01B 7/0869; H01B 7/087; H01B 7/0208; H01B 7/0216; H01B 7/225; H01B 7/228; H01B 11/007; H01B 11/02; H01B 7/0876; H01B 7/28; Y10T 29/49123; Y10T 29/49201
See application file for complete search history.

(56) References Cited

U.S. PATENT DOCUMENTS 3,790,694 A * 2/1974 Portinari ..... H01B 13/14 174/107
3,855,051 A * 12/1974 Lania ..... H01B 7/0216 174/120 R (Continued)

FOREIGN PATENT DOCUMENTS

JP 02149808 A * 6/1990

*Primary Examiner* — A. Dexter Tugbang
(74) *Attorney, Agent, or Firm* — Carmen Pili Ekstrom

(57) ABSTRACT

A method of manufacturing an improved overhead or underground telephone lead-in cable for transmission services VVDL (voice, video, data and lead-in) that permits the connection of the users to the public telephone system with a high speed digital service link, besides the analog services required. The cable has at least one or a plurality of transmission circuits. One of the transmission circuit is formed by two metal conductor elements cooperating in turn to self-support the cable or a conventional type of impregnated fibers or kevlar tape. The second circuit which is formed by a stranded pair of conductors is impregnated with a swelling powder preventing moisture penetration.

18 Claims, 3 Drawing Sheets

(52) U.S. Cl.
CPC ..... *H01B 7/0869* (2013.01); *H01B 7/0876* (2013.01); *H01B 7/225* (2013.01); *H01B 7/228* (2013.01); *H01B 7/28* (2013.01); *H01B 11/007* (2013.01); *H01B 11/02* (2013.01); *H01B 13/016* (2013.01); *H01B 13/14* (2013.01); *Y10T 29/49123* (2015.01); *Y10T 29/49201* (2015.01)

(56) References Cited

U.S. PATENT DOCUMENTS

| | | | | | |
|---|---|---|---|---|---|
| 4,467,138 | A * | 8/1984 | Brorein | H01B 11/02 | 174/115 |
| 4,761,053 | A * | 8/1988 | Cogelia | H01B 7/183 | 385/102 |
| 5,010,210 | A * | 4/1991 | Sidi | H01B 11/02 | 174/113 R |
| 5,155,304 | A * | 10/1992 | Gossett | H01B 7/38 | 174/117 F |
| 5,180,890 | A * | 1/1993 | Pendergrass | H01B 7/38 | 174/117 F |
| 5,698,615 | A * | 12/1997 | Polle | H01B 7/288 | 174/24 |
| 6,064,008 | A * | 5/2000 | Craton | H01B 7/295 | 174/110 FC |
| 6,103,317 | A * | 8/2000 | Asai | H01B 7/288 | 106/14.05 |
| 6,509,526 | B2 * | 1/2003 | Osornio | H01B 7/225 | 174/117 F |
| 2002/0003047 | A1 * | 1/2002 | Osornio | H01B 7/225 | 174/117 F |

* cited by examiner

METHOD FOR MANUFACTURING AN IMPROVED OVERHEAD AND UNDERGROUND CABLE LEAD-IN CABLE FOR VOICE, DATA AND VIDEO TRANSMISSION SERVICES

This is a divisional patent application of U.S. patent application Ser. No. 10/780,021, filed on Feb. 17, 2004.

BACKGROUND OF THE INVENTION

1. Field of the Invention

The instant invention relates to a method of manufacturing an overhead or underground telephone lead-in cable for voice, video, data and lead-in type services (VVDL) permitting the connection of the users to the public telephone system with high speed digital services link besides offering analog services. This is made possible through the integration of a balanced circuit to the original design of two elements made of metal, plastic or kevlar fibers, in parallel, also serving as self-supporting elements in overhead installation. Said cable is characterized because its core is protected by a moisture resistant film and is thus highly convenient for overhead or underground installation.

2. Previous Art

Generally, the overhead lead-in lines of the unitary telephone services have been limited with regard to their bandwidth and resistance to radio interferences because of their design. The demand for transmission means able to support a bandwidth large enough to meet the growing demand for digital services in the coming years also requires designs that do not increase the costs or limit the ease of installation of the current products. With regard to the cables used for the connection of the users to the telephone network, the design and method of manufacture are decisive factors. The cable should be light and economical and permit high-speed data transmission above 155 Mbps. It should also have an adequate response in frequencies above 100 Mhz and be self-supporting over distances spanning more than 100 meters. Moreover, the cable should be weather-resistant and in windy and icy conditions, it should permit its reinforcement without being necessary to modify its shape, so that the same anchorage elements usually used in this type of services can be utilized.

Among the known techniques used to solve the above-mentioned problems, in U.S. Pat. No. 4,467,138, a "conductive cable for plural communications" is described, the design of which is related to a flat communication conductor. Said flat communication conductor has two or more communication ports, polyolefin insulated cables united throughout its length arranged in groups on opposed and parallel sides of a conductive steel wire.

Even though cables presenting stranded pairs of conductors are known, not all of them have the same application, i.e., depending upon their use, the design varies in each case and even the number of pitches of the stranded pair presents differences. For example, in U.S. Pat. No. 6,064,008, a communication cable having two pair of stranded conductors is described, the main characteristic of which it is not the stranded pairs but the insulating filling material based on a chemical product of fluorinated polymer with a blowing agent. In U.S. Pat. No. 6,509,526 D, anteriority of the instant invention, a telephone lead-in cable is described for ordinary voice service and high performance Data and Video transmission services. Said cable is based on a thermoplastic sleeve, with a data transmission circuit having two metal wires helically united within a thin protective band resisting to temperatures up to 240° C. At the center of said thermoplastic sleeve, a circuit element for voice transmission based on two parallel metal conductors is arranged. Each one of said metal conductors is opposed to the helical union of the first circuit.

Thus, for example in U.S. Pat. No. 4,761,053, an overhead lead-in cable is described which includes a rectangular cross-section sleeve with two tension members based on various filaments impregnated with a sleeve compatible material. Each said member is arranged opposite a pair of conductors and at least one of them is made of optic fiber and vertically aligned, in parallel.

In U.S. Pat. No. 5,180,890, a cable is described which is also of a rectangular type, including two tension members, one placed at each end of the sleeve and two copper conductors separated and horizontally aligned, in parallel.

In U.S. Pat. No. 5,155,304, an overhead lead-in cable is described with an embodiment of 4 or more tension members based on intertwined filaments impregnated with a plastic material forming a reinforcement thread for the catenary elongation tension. Said overhead lead-in cable also has two or more insulated copper conductors placed in the center of the thermoplastic sleeve, vertically aligned and in parallel or in the shape of a cross forming and interstice between the insulated conductors.

The applicant has developed an improved VVDL-type lead-in cable for overhead or underground installation, based on a design of self-supporting elements for overhead lead-in lines and a dedicated circuit permitting a high-speed digital signal transmission without interfering at all with the voice service signals or the use of additional electronic circuits to separate the signals. The design that is also highly resistant to diaphony, is characterized because it has a core of two insulated conductors impregnated with a surrounding layer of moisture absorbing swelling powder.

DESCRIPTION OF THE INVENTION

The accompanying drawings, which are incorporated in and constitute part of this specification, are included to illustrate and provide a further understanding of the instant invention.

DETAILED DESCRIPTION OF THE INVENTION

Figure 1:
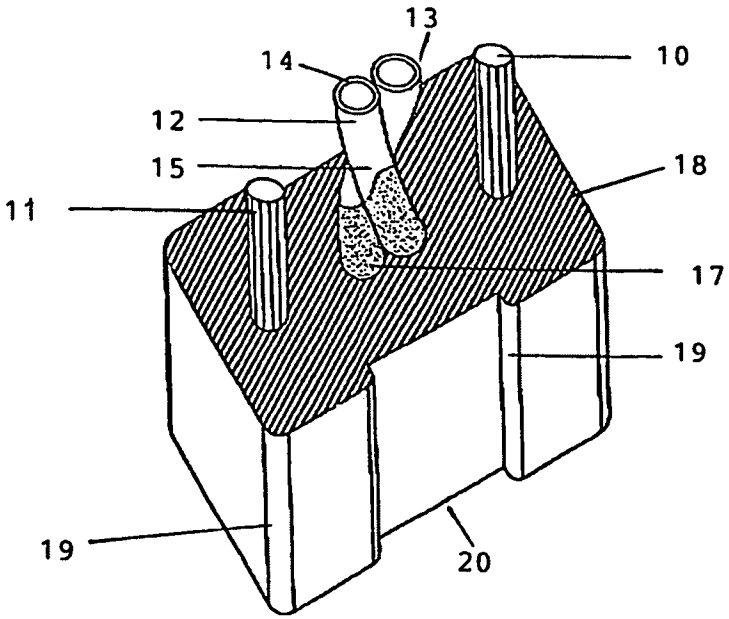
FIG. 1 is an isometric view with a cross-section of the telephone lead-in cable for data and voice transmission services (VVDL), showing the distribution of its elements with moisture protection layer.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

As used herein, the tension members 10 and 11 are made of metal cylindrical conductors and between them create additional circuit for transmission of digital and analog signals. They are made of metal alloys or composition of two metals tempered with a treatment with high rupture strength. They act as self supporting members. They are made of glass fibers impregnated with polymers or kevlar tapes. The design of self-supporting elements for overhead lead-in lines provides a dedicated circuit permitting a high-speed digital signal transmission without interfering at all with the transmission of voice service signals or the use of additional electronic circuits to separate the signals. The design that is also highly resistant to diaphony and is characterized because it has a core of two insulated conductors impregnated with a surrounding layer of moisture absorbing swelling powder.

As used herein, 12 and 13 are stranded pair of wires and individually insulated with polyolefinic material, polyethylene or polypropylene, and stranded together. They are the conductive elements of the circuits. The circuits permit transmission of data at relative high speed (155 Mbps). The voice circuit elements are placed in stranded pair of wires 12 and 13 of central core 15 but can also be incorporated in tension members 10 and 11 when they are acting as self-supporting members and are made of metal conductors.

As used herein, the thermoplastic compound layer 14 is applied continuously and uniformly. Each one of the conductive elements is individually insulated with thermoplastic compound layer 14 applied continuously and highly uniform insuring a concentricity of the wall of insulating material with regard to the conductor above 90-92%.

As used herein, the central core, 15 is also referred to as balanced circuit, second transmission circuit or stranded pair of insulated wires are coated with swelling material 17 and then optionally covered with mylar tape 16, a moisture resistant film. It forms a balanced circuit of 100 ohms impedance.

As used herein, the moisture resistant film or mylar tape 16 is applied alternately when the external cover of cable is applied. It is applied helicoidally, longitudinally on the protective cover. The film is a protective film and temperature resistant and can resist a temperature of up to 240° C.

As used herein, the layer of swelling powder material 17 is a protective layer. The layer is employed against direct moisture when the cable is installed underground or against rain the cable is for overhead installation. The swelling material is employed in a quantity that is proportional to the required thickness of the film. The swelling material is applied helically. The swelling material bobbins are installed concentrically over the metal pipe that serves as a guide inner core. A couple of binder bobbins are mounted on the metal pipe to avoid missing the binder during the entire cable length. The swelling material is applied over the cable core to avoid water traffic along the cable and reaches the enclosure where the optical fiber or copper conductors have splices such as cases of cable jacket which had undergone tears or damage because of installation friction or rodent attack.

As used herein, the circuit and self-supporting members are extruded with a thermoplastic material 18 protecting them against the environment and facilitating the handling of the cable in installation in spans longer than 100 meters. The cover 18 protects both elements against mechanical damage that could be caused during the storage, transportation and installation.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The main object of the new Voice, Video and Data (VVDL) telephone lead-in cable is to prevent moisture penetration into the core of the VVDL cable, when it is used in overhead service and exposed to moisture penetration from rain, or when said cable is installed in underground ducts and directly exposed to extremely moist environments. The core formed by two insulated conductors is characterized because it incorporates outside around the conductors a moisture absorbing powder film of swelling material preventing water penetration inside said core.

The film is applied alternately through an electrostatic system when the external cover of the cable is applied. Said system permits the distribution of the film in a controlled way, and the deposit of the swelling material in a quantity that is proportional to the required thickness of said film. The VVDL-type (Voice, Video, Data, Lead-in) lead-in cable (A) includes two self-supporting metal elements for overhead lead-in lines 10, 11 and can also transmit voice signals when the members are made of metal because, between them, they create an additional circuit dedicated to the transmission of analog and digital signals. It also includes a circuit permitting the transmission of data at relative high speed formed by two metal wires 12 and 13 individually insulated with a polyolefinic material, polyethylene or polypropylene, and stranded together, forming a balanced circuit of 100 ohms impedance 15, FIGS. 1, 2 and 3. It is characterized by a high resistance to diaphony that could occur through the conjugation of the elements in the same transmission plane. The stranded pair of insulated wires 15 or balanced circuit can be covered by a very thin mylar tape 16 of a material resisting at temperatures up to 240° C., only when said thermal protection is required by the installation conditions. Between the conductive elements of the circuits 12 and 13 and the protective film 16 or sleeve 18 area when it is not included into said film 16, a swelling powder layer based on a superabsorbing polymer is formed. The protective layer 17 is against direct moisture when the cable is installed underground or against rain the cable is for overhead installation. The circuit and self-supporting members are extruded with a thermoplastic material 18 protecting them against the environment and facilitating the handling of the cable in installation in spans longer than 100 meters. The geometrical figure of the cable (A) permits said cable to be submitted to tension or compression through anchorage elements without any of the transmission components being damaged which could deteriorate its electrical characteristics.

Figure 2:
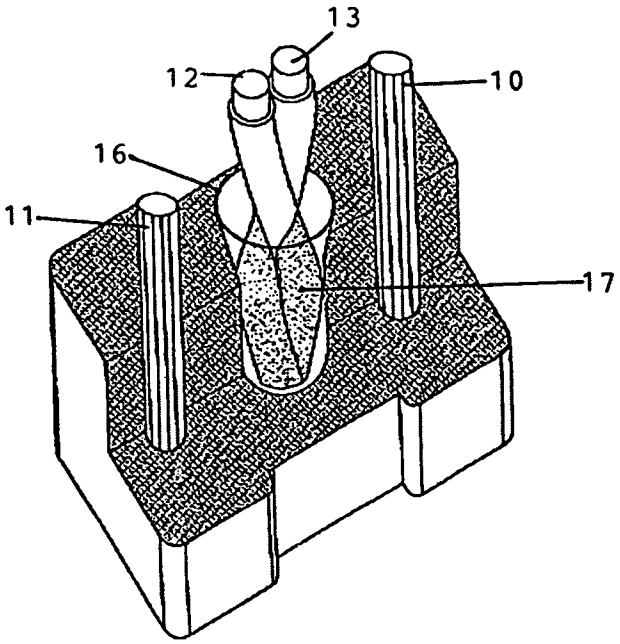
FIG. 2 is a cross-sectional view of FIG. 1, showing the arrangement of one or more transmission circuits in a cable and only with the moisture protection.
Figure 3:
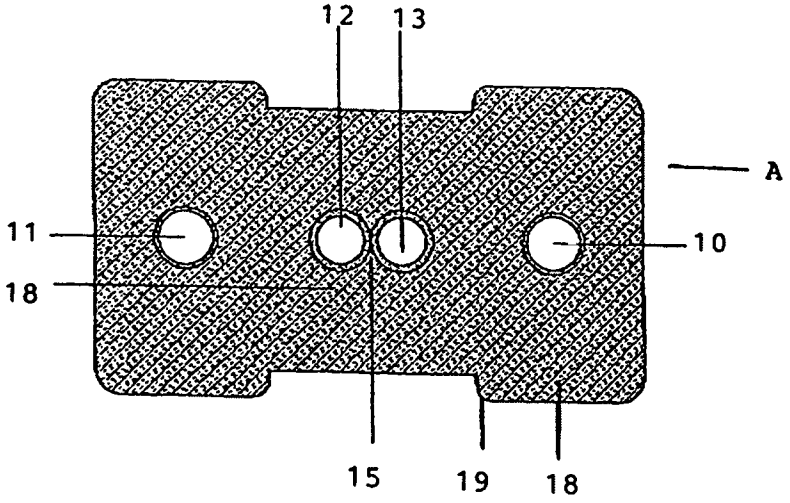
FIG. 3 is a cross-sectional view of FIG. 1, showing the helical reunion of the fusion protection tape and with a swelling material layer.

Lead-in Cable (VVDL) FIGS. 1 to 3

The cable object of the instant invention (A), is a rectangular elongated body at the ends of which corner pieces are placed 19, which are rounded for better installation handling. Said cable also presents recesses 20 in its lateral ends, in the middle part, to create a semi-rectangular geometrical shape submitted to lower tensile stress.

The lead-in cable (A) has, equidistantly distributed in its structure 18, one or several transmission circuits, which do not require for their installation any special type of fittings for fixing them onto the terminal distribution post or box of the telephone network and the house of the consumer or user of the telephone services. The voice circuit elements are preferably placed in the stranded pair of wires 12 and 13 of the central core 15, but can also been incorporated in the tension members 10, 11 when they are made of metal conductors acting as self-supporting elements. In this case, said elements 10, 11 are made of metal cylindrical conductors, without limitation as to their composition and cross section, i.e., the elements can be of metal alloys or composition of two metals tempered with a treatment permitting a high rupture strength. This is because said elements are self-supporting and are also supporting the other elements conforming the cable. However, the thermal treatment must be between 45° C. and 550° C. Through a treatment of this type, said conductors or self-supporting metal elements do not substantially lose their resistance characteristics to the passage of electrical current. Said elements 10, 12 are placed longitudinally in parallel between them and are separated by a 4 to 6 mm distance permitting the placement of the second transmission circuit 15 between them. Said elements are arranged to offer an appropriated means for transmitting digital signals 12 at relatively high speeds (155 Mbps). They are made of quasi cylinder mild copper metal conductors, 100% pure and stranded with a smooth surface of a diameter of 0.5 to 0.64 mm, permitting spans on distances of up to 150 meters and with relatively low losses of 22 Db/100 at 100 MHz. Each one of the conductive elements is individually insulated with a thermoplastic compound layer 14 applied continuously and highly uniform insuring a concentricity of the wall of insulating material with regard to the conductor above 90-92%. Said insulating layer can be applied in only one layer or in various layers and each one of the insulating layers is colored to facilitate its identification. The material used for layers can be solid, expanded through physical or chemical action or can have compounds delaying or inhibiting flame propagation. The insulated conductors are stranded 15, forming a pair or balanced circuit the distance between each strand of the conductors being such that it permits to minimize the diaphony effects caused by the proximity of other element emitting electromagnetic signals and to reduce the exit of energy towards the other circuit. The stranded pair 15 shows an optimum performance because the control of the wall thickness and the helix of each one of the stranded conductors to form the pair insure the stability of the characteristic impedance at relative high frequencies. Moreover, the circuit remains in an excellent electrical balance minimizing in this way the interference of external agents. The balance circuit or stranded pair 15 is optionally covered by a thin tape protecting against melting, made of temperature resistant material, 16 applied helicoidally or longitudinally onto said protective cover when it is required for the installation. The tape prevents a melting of the insulation material among themselves and/or among the compound of the cover during the application of the outer cover 18 through an extrusion process, and because of heat transfer from the compound to the insulated conductors. Moreover, this tape also acts as a barrier to prevent the invasion of the transmission area of the balanced circuit by the compound of the cover. It also acts as a barrier to prevent the modification of its dielectric constant and in turn its characteristic impedance that increases the circuit loss because of a higher capacitance. It also presents a cover reinforced by its design based on a thermoplastic compound 18 forming an integral body and maintaining the self-supporting elements on each side and diametrically parallel opposite to the stranded pair.

The space between the protection tape 16 and the core of the strand 15, is impregnated through electrostatic means with a layer of swelling powder material which is a poly (sodium acrylate) homopolymer commercial product.

The cover 18 protects both elements against mechanical damage that could be caused during the storage, transportation and installation. The compound of the cover is weather resistant according to the installation area and protects also the circuits against premature aging through the action of sun, water or any other external agent. This compound can also be flame retardant if it is required where the cable is installed.

The design of the cable body has a rectangular geometrical shape with trimmed edges 19, and recesses 20 permitting the product to be installed using any of the fixing fittings currently designed. Moreover, it is possible to avoid that the components be damaged by the tensile and compression stresses to which they are submitted during installation and daily functioning.

ADVANTAGES OF THE INVENTION

The advantage of the cable design is the tensile strength, i.e., the increase of the installation span distance that can be solved through the change of the cross section of the support elements or the type of material used in their manufacturing.

The use of swelling powder on the paired core permits the direct use of the cable in underground installations because the absorbing material prevents the penetration of the moisture usually found in underground installation areas.

VVDL Cable Characteristics

Additionally, the cable withstands a crushing test of 1000 lb/f (14.88 kg/cm) which meets the underground conditions. The cable of U.S. Pat. No. 6,509,526 B2 includes 24 AWG conductors as components of the conductive core of the VVDL cable while the instant invention permits the development of new cable constructions from 16 to 26 AWG cables.

The electrical performance of the new VVDL cable of two 24 AWG conductors fulfils the following electrical characteristics.

TABLE 1

Electrical Characteristics

| Characteristics | Unit | Specified |
|---|---|---|
| Resistance | Ohms/km | 89.5 max |
| Resistance Unbalance | % | 5 max |
| Insulation resistance | Megaohms/km | 5000 min. |
| Mutual Capacitance | NF/km | 75 max. |
| Grounding Capacitance Unbalance | PF/km | 2595 max. |
| High Voltage between Conductors | VDC | 1200 |

TABLE 2

| Frequency MHz | Attenuation dB/100 m |
|---|---|
| 1 | 2.20 |
| 4 | 4.62 |
| 8 | 6.88 |
| 10 | 7.85 |
| 16 | 10.46 |
| 20 | 12.03 |
| 25 | 13.88 |
| 31.25 | 16.04 |
| 62.5 | 25.62 |
| 100 | 35.78 |

TABLE 3

| Mechanical and dimensional characteristics of the cable | | |
|---|---|---|
| Characteristics | Unit | Specified |
| Gauge | AWG | 24 |
| Conductor diameter | mm | 0.51 rated |
| Insulation diameter | mm | 0.904 rated |
| Width (A) | mm | 5.50 ± 0.35 |
| Height (B) Channel | mm | 4.10 ± 0.35 |
| Width (D) | mm | 15 |
| Depth (c) | mm | 0.27 |
| Rupture load | Kgf | 80 |
| Packing length | m | 250 |
| Approx. weight | Kg/km | 32 |

The self-supporting members, i.e., the tensile members 10, 11 are made of conventional glass fibers impregnated with polymers or kevlar tapes when the lead-in cable includes only one transmission circuit.

It will be apparent to those skilled in the art that various modifications and variations can be made in the lead-in cable of the instant invention without departing from the spirit or scope of said invention. Thus, the present invention is not limited by the foregoing descriptions but is intended to cover all modifications and variations that come within the scope of the spirit of the invention and the claims that follow.

The invention claimed is:

1. A method for manufacturing an overhead or underground telephone lead-in cable for voice, video and data (VVDL) transmission services, said cable comprising a core having self supporting member comprising conducting elements impregnated with moisture absorbing swelling powder, said method comprising the steps of:

a) constructing a rectangular structure comprising a rectangular outer cover having a geometrical shape comprising a thermoplastic material;

b) arranging positioning at least one or a plurality of transmission circuits; forming a first transmission circuit by extruding a self-supporting member with the thermoplastic material to form an extruded cover; said self-supporting member comprising two conducting elements upwardly projecting therefrom the rectangular structure; said conducting elements comprising a material selected from a group consisting of metal, alloys, fiberglass and combinations thereof;

c) arranging conducting elements at opposite ends, in parallel, and in turn are diametrically opposed to the first transmission circuit;

d) forming a second transmission circuit with the cable comprising the core having a pair of stranded conductors at a center of the rectangular structure;

e) insulating each one of the stranded conductors with a thermoplastic compound layer; applying die insulation continuously and uniformly such that concentricity of a wall of insulating material with regard to the conductor is higher than 90-92%; and colored for identification purposes;

f) electrostatically depositing and positioning a swelling material layer as a moisture absorbing protection surrounding the core; arranging said swelling material layer between an area around a thin thermoplastic sleeve and the core of the stranded conductors and impregnating spaces with the swelling material layer;

g) applying helicoidally or longitudinally a the thin thermoplastic sleeve as a fusion protective tape material which is temperature resistant material on the pair of stranded conductors to resist a temperature of up 240° C.; controlling wall thickness and helix of each one of the stranded conductors to obtain a characteristic impedance stability at relatively high frequency;

h) helically uniting the fusion protective tape material with the swelling material layer and the core: said fusion protective tape material selected from the group consisting of polymers, kevlar tapes and mylar tapes:

i) trimming edges at a corner of the rectangular structure and recesses at lateral ends to provide a lower tensile stress; and j) reinforcing the extruded cover with the thermoplastic material to form the lead-in cable; and k) developing cable constructions of from at least 16 AWG to 26 AWG conductors as components of the core.

2. The method for manufacturing an overhead or underground telephone lead-in cable for transmission services (VVDL) of claim 1, further comprising the step of impregnating the conducting elements with a material selected from the group consisting of polymers, kevlar tapes and mylar tapes.

3. The method for manufacturing an overhead or underground telephone lead-in cable for transmission services (VVDL) of claim 2 wherein the polymer is selected from the group consisting of polyolefins, polyethylene, polypropylene, and combinations thereof.

4. The method for manufacturing an overhead or underground telephone lead-in cable for transmission services (VVDL) of claim 1, further comprising forming the circuit with a stranded pair or balanced circuit in order to provide the characteristic impedance of 100 ohms.

5. The method for manufacturing an overhead or underground telephone lead-in cable for transmission services (VVDL) of claim 1, wherein the swelling material layer comprises a swelling powder which is a poly(sodium acrylate) homopolymer compound.

6. The method for manufacturing an overhead or underground telephone lead-in cable for transmission services (VVDL) of claim 1, further comprising the step of electrostatically applying the swelling material layer to form a cover layer on the stranded pair of stranded conductors during the extrusion of the thermoplastic material to provide a flame resistant reinforced thermoplastic cover.

7. The method for manufacturing an overhead or underground telephone lead-in cable for transmission services (VVDL) of claim 1 wherein the self-supporting member is made of material selected from metal, metal alloys or composition of two metals tempered with a treatment with high rupture strength.

8. The method for manufacturing an overhead or underground telephone lead-in cable for transmission services (VVDL) of claim 7, further comprising providing the self-supporting member as an additional circuit with regard to the core, enhancing the transmission of voice signals such that they constitute a circuit oriented to the transmission of analog and digital signals.

9. The method for manufacturing an overhead or underground telephone lead-in cable for the transmission services (VVDL) of claim 1, further comprising providing a circuit of the stranded pair in order to permit transmission of digital signal data at speeds of 155 Mbps.

10. The method for manufacturing an overhead or underground telephone lead-in cable for the transmission services (VVDL) of claim 1, further comprising stranding the pair of conductors with a smooth surface at a diameter of 0.50 to 0.64 mm.

11. The method for manufacturing an overhead or underground telephone lead-in cable for transmission services (VVDL) of claim 1, further comprising changing cross section of a support element or a type of material to allow the cable to span distances of up to 150 meters, and permit the distance between each strand of the conductors to reduce the diaphony effects caused by the nearness of other element emitting electromagnetic signals, and reduce loss of energy to the other circuit.

12. The method for manufacturing an overhead or underground telephone lead-in cable for transmission services (VVDL) of claim 1, further comprising subjecting the conductors to thermal treatments at temperature between 45° C. and 550° C.

13. The method for manufacturing an overhead or underground telephone lead-in cable for transmission services (VVDL) of claim 1, further comprising forming a pair of balanced circuit between each strand of the insulated conductors.

14. The method for manufacturing an overhead or underground telephone lead-in cable for transmission services (VVDL) of claim 1, further comprising applying the protective tape material alternately when the thermoplastic sleeve of the cable is applied.

15. The method for manufacturing an overhead or underground telephone lead-in cable for transmission services (VVDL) of claim 1 further comprising arranging the self-supporting members longitudinally in parallel and separating them by a 4 to 6 mm distance permitting the placement of the second transmission circuit between them.

16. The method for manufacturing an overhead or underground telephone lead-in cable for transmission services (VVDL) of claim 1, further comprising subjecting the resulting cable to a crushing test of 1000 lb/f and withstanding the test.

17. The method for manufacturing an overhead or underground telephone lead-in cable for transmission services (VVDL) of claim 1, further comprising incorporating voice circuit elements in self-supporting members made of metal conductors.

18. The method for manufacturing an overhead or underground telephone lead-in cable for transmission services (VVDL) of claim 1, further comprising incorporating voice circuit elements in stranded conductors of the core.

* * * * *